US005159999A

United States Patent [19]

Voigt

[11] Patent Number: 5,159,999

[45] Date of Patent: Nov. 3, 1992

[54] CONTAINER WITH A TUBE INSERT

[76] Inventor: Bernard Voigt, 15 High St., Hicksville, N.Y. 11801

[21] Appl. No.: 791,004

[22] Filed: Nov. 12, 1991

[51] Int. Cl.[5] ..... A45C 13/40

[52] U.S. Cl. ..... 190/111; 150/106; 150/117; 190/102; 206/315.5

[58] Field of Search ..... 150/106, 117; 190/102, 190/111; 229/120.03; 383/40; 206/315.3, 315.5

[56] References Cited

U.S. PATENT DOCUMENTS

| | | | |
|---|---|---|---|
| 1,532,941 | 4/1925 | Pierce | 206/315.5 |
| 1,574,644 | 2/1926 | Fiering et al. | 150/117 |
| 1,699,048 | 1/1929 | Connor | 206/315.5 |
| 1,709,582 | 4/1929 | Kahle | 206/315.5 |
| 1,726,245 | 8/1929 | Shelton | 206/315.6 |
| 1,829,093 | 10/1931 | Hollins | 206/315.5 |
| 1,863,150 | 6/1932 | Allen | 150/117 |
| 1,895,744 | 1/1933 | Arnold | 190/111 |
| 2,034,398 | 3/1936 | Kash | 150/117 |
| 2,369,943 | 2/1945 | Broudy | 150/117 |
| 2,394,332 | 2/1946 | Salem | 150/117 |
| 3,756,299 | 9/1973 | Simmons et al. | 206/315.3 |
| 3,957,141 | 5/1976 | Domes | 190/102 |
| 4,170,317 | 10/1979 | Fisher | 206/315.3 |
| 4,171,011 | 10/1979 | Kopin | 150/117 |
| 4,236,615 | 12/1980 | Ginat | 190/111 |
| 4,354,542 | 10/1982 | Gerch | 150/106 |

FOREIGN PATENT DOCUMENTS

| | | | |
|---|---|---|---|
| 280124 | 11/1927 | United Kingdom | 190/102 |

*Primary Examiner*—Gary E. Elkins
*Attorney, Agent, or Firm*—Michael I. Kroll

[57] ABSTRACT

A container with a tube insert for holding various articles is provided which consists of a receptacle in which material is held and carried therein. A structure, incorporated within the receptacle, is for holding an article therein. A mechanism, incorporated to the receptacle and in conjunction with the holding structure, is for removing the article therefrom without a person having to open the receptacle.

11 Claims, 2 Drawing Sheets

CONTAINER WITH A TUBE INSERT

BACKGROUND OF THE INVENTION

1. Field of the Invention

The instant invention relates generally to receptacles and more specifically it relates to a container with a tube insert for holding various articles.

2. Description of the Prior Art

Numerous receptacles have been provided in prior art that are adapted to hold, store or contain different types of objects therein. While these units may be suitable for the particular purpose to which they address, they would not be as suitable for the purposes of the present invention as heretofore described.

SUMMARY OF THE INVENTION

A primary object of the present invention is to provide a container with a tube insert for holding various articles that will overcome the shortcomings of the prior art devices.

Another object is to provide a container with a tube insert for holding various articles, whereby the tube insert is not a complicated structure for installation into the container, but is rather a simple unit that is connected within the container.

An additional object is to provide a container with a tube insert for holding various articles in which the container includes an easy access cover for the tube insert to remove the article therein, so that there is no need to open the container to remove the article.

A further object is to provide a container with a tube insert for holding various articles that is simple and easy to use.

A still further object is to provide a container with a tube insert for holding various articles that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3:
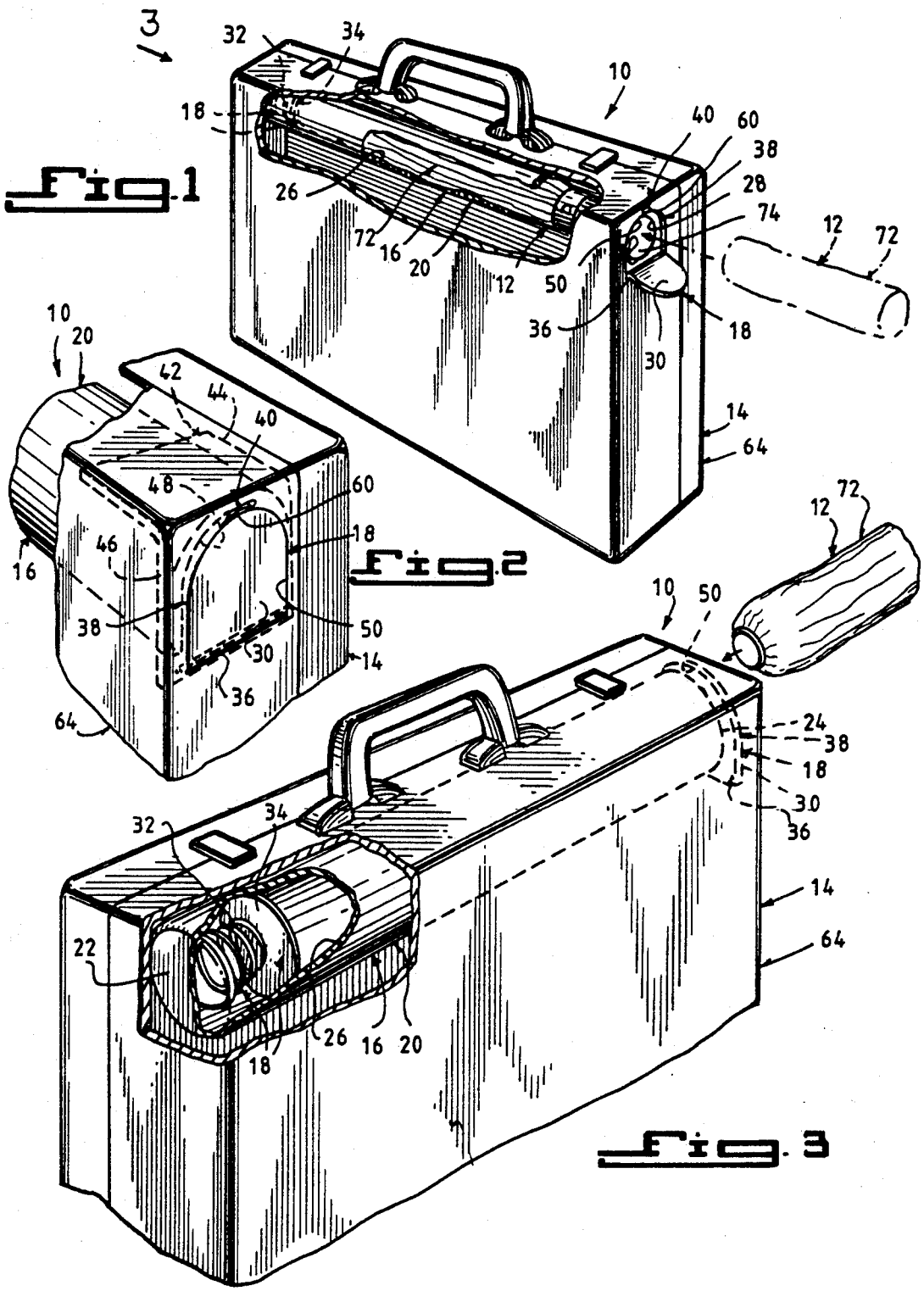
FIG. 1 is a perspective view of a briefcase with parts broken away showing the tube insert therein and the easy access cover opened.
FIG. 2 is an enlarged perspective view of a portion of the briefcase showing the easy access cover closed.
FIG. 3 is an enlarged perspective view of a portion of the briefcase with parts broken away taken in direction of arrow 3 in FIG. 1, showing the spring and disc within the tube insert in detail.

Turning now descriptively to the drawings, in which similar reference characters denote similar elements throughout the several views, the Figures illustrate a container with a tube insert 10 for holding various articles 12, which consists of a receptacle 14 in which material is held and carried therein. A structure 16, incorporated within the receptacle, is for holding an article 12 therein. Mechanism 18, incorporated to the receptacle 14 and in conjunction with the holding structure 16, is for removing the article 12 therefrom without a person having to open the receptacle 14.

The holding structure 16 includes an elongated hollow cylinder 20 having a closed end 22, an opened end 24 and a compartment 26 for holding the article 12 therein. The elongated hollow cylinder 20 can be fabricated out of metal or plastic.

The removing mechanism 18 includes the receptacle 14 having an aperture 28 thereto. An easy access cover 30 is connected to the receptacle 14 at the aperture 28 and the opened end 24 of the elongated hollow cylinder 20. The removing mechanism 18 further includes a spring 32 inserted within the compartment 26 of the elongated hollow cylinder 20 and against the closed end 22 thereof. A disc member 34 is inserted within the compartment 26 of the elongated hollow cylinder 20 and is attached to the free end of the spring 32, so as to help eject the article 12 therefrom, when the easy access cover 30 is placed in an opened position. The spring 32 and the disc member 34 can be optional and are not needed in some types of receptacles 14.

The easy access cover 30 further includes a hinge 36 connected between one side of the easy access cover 30 and the receptacle 14, so that the easy access cover 30 can be pivoted to the opened position and a closed position at the opened end 24 of the elongated hollow cylinder 20. An apparatus 38 is for retaining the easy access cover 30 when in the closed position over the opened end 24 of the elongated hollow cylinder 20, so as to keep the article 12 within the compartment 26 in the elongated hollow cylinder 20. A device 40 is for assisting the easy access cover 30 into the opened position.

The easy access cover 30 can possibly include a push button that will be used to open the cover. A lock of some kind, such as a key type, could also be used to safe guard the contents within the elongated hollow cylinder 20.

As shown in FIG. 2, an L-shaped brace member 42 can be provided having a pair of legs 44, 46 with a hole 48 through the leg 46. The brace member 42 is mounted within the receptacle 14 at the aperture 28, so that the leg 46 with the hole 48 is positioned over the opened end 24 of the elongated hollow cylinder 20 behind the easy access cover 30 to give extra support thereto. The L-shaped brace member 42 is also there to support a corner of the receptacle 14, as well as the elongated hollow cylinder 20.

The retaining apparatus 38, as shown in FIGS. 1 through 3, includes the receptacle 14 having a recessed area 50 at the aperture 28 and at the opened end 24 of the elongated hollow cylinder 20 and is of the same size as the easy access cover 30. When the easy access cover 30 is placed in the closed position the recessed area 50 will retain it snugly thereto.

Figures 4, 4A, 5, 6, 6A:
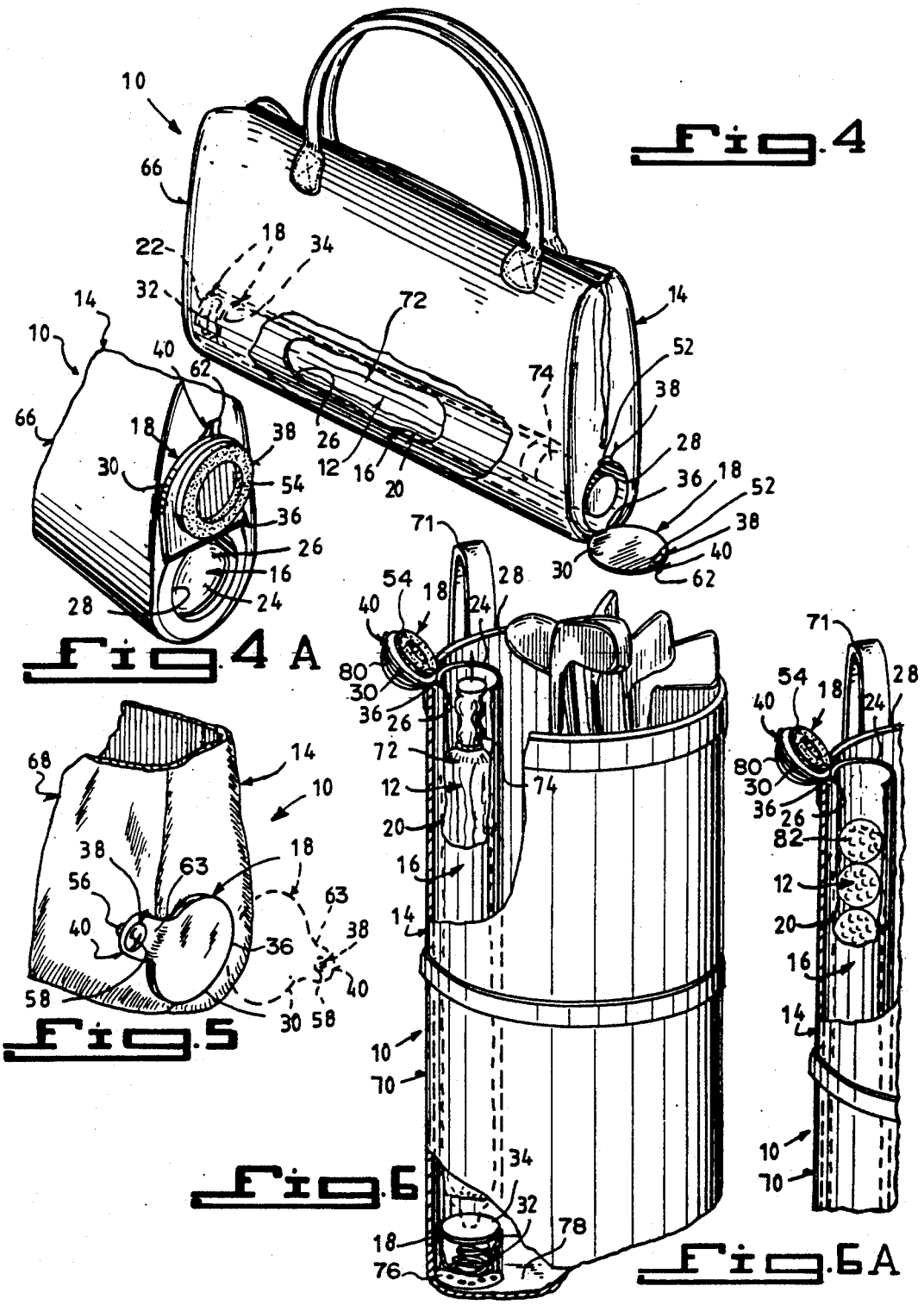
FIG. 4 is a perspective view of a ladies handbag with parts broken away showing the tube insert therein and a second type of easy access cover opened.
FIG. 4A is an enlarged perspective view of a portion of the ladies handbag showing a third type of easy access cove opened.
FIG. 5 is an enlarged perspective view similar to FIG. 4A showing a fourth type of easy access cover closed and opened in phantom in a piece of travel luggage.
FIG. 6 is a perspective view of a golf bag with parts broken away showing the tube insert therein and fifth type of easy access cover opened.
FIG. 6A is a perspective view of a portion of the golf bag shown in FIG. 6 holding golf balls therein.

As shown in FIG. 4, the retaining apparatus 38 is a latch member 52 between one side of the easy access cover 30 and the aperture 28 of the receptacle 14.

The retaining apparatus 38, shown in FIG. 4A, and 6 and 6A includes a ring seal gasket 54 made of rubber or the like mounted to the back of the easy access cover 30. When the easy access cover 30 is placed in the closed position, the ring seal gasket 54 will fit snugly within the aperture 24 of the elongated hollow cylinder 20. The retaining apparatus 38 in FIG. 5 includes a female snap fastener 56 affixed to one side of the aperture 28 on the receptacle 14. A male snap fastener 58 is affixed to one side of the easy access cover 30, which will engage with the female snap fastener 56, when the easy access cover 30 is placed in the closed position.

The assisting device 40, as best seen in FIG. 2, includes the receptacle 14 having a finger notch 60 formed in the recessed area 50, so that a person can insert a fingernail into the finger notch 60 and pull the easy access cover 30 into the opened position. The assisting device 40 in FIG. 4, includes a finger grip 62 on the easy access cover 30, so that a person can engage the finger grip 62 and pull the easy access cover 30 into the opened position. The assisting device 40 in FIG. 4A, also includes the finger grip 62 on the easy access cover 30, so that a person can engage the finger grip 62 and pull the easy access cover 30 into the opened position. The assisting device 40 in FIG. 5, includes a flap member 63 extending from the easy access cover 30 and having the male snap fastener 58 attached thereto. A person can engage the flap member 63 and pull the easy access cover 30 into the opened position.

The receptacle 14 is a hand held carrier case and can include a briefcase 64, shown in FIGS. 1 through 3, a ladies handbag 66, shown in FIGS. 4 and 4A, a piece of travel luggage 68, shown in FIG. 5. The receptacle 14 can also be a golf bag 70, shown in FIGS. 6 and 6A. The receptacle 14 can be a metal briefcase, a soft leather briefcase with retractable soft leather handles, a shoulder bag made of cloth, leather, vinyl or some other soft material, for men or women, a duffle bag, a child or teenager school bag being a double shoulder bag, a hand held bag, or any other hand held receptacle.

As shown in the drawings, the article 12 is a compact spike type umbrella 72 with a straight handle 74. Other types of articles 12 can also be utilized, such as documents, batteries, writing instruments, rulers and the like. In FIG. 6A the article 12 includes a plurality of golf balls 82.

The golf bag 70 has a shoulder strap 71, as shown in FIG. 6 and is especially designed to accommodate the compact spike type umbrella 72 with the straight handle 74. A Water drain 76 can be at the bottom 78 of the golf bag 70, where the elongated hollow cylinder 20 is vertically positioned. The closed end 22 is eliminated, so that water will not collect at the bottom of the elongated hollow cylinder 20 to corrode the spring 32, but rather exit through the water drain 76. The easy access cover 30 shaped at 80 and is similar to an outdoor electrical outlet cover.

LIST OF REFERENCE NUMBERS

10 container with a tube insert
12 article
14 receptacle
16 holding structure
18 removing mechanism
20 elongated hollow cylinder
22 closed end of 20
24 opened end of 20
26 compartment in 20
28 aperture in 14
30 easy access cover
32 spring
34 disc member
36 hinge
38 retaining apparatus
40 assisting device
42 L-shaped brace member
44 first leg of 42
46 second leg of 42
48 hole in 46
50 recessed area at 28
52 latch member
54 ring seal gasket
56 female snap fastener on 14
58 male snap fastener on 30
60 finger notch in 50
62 finger grip on 30
63 flap member
64 briefcase
66 ladies handbag
68 piece of travel luggage
70 golf bag
71 shoulder strap for 70
72 compact spike type umbrella
74 straight handle on 72
76 water drain in 70
78 bottom of 70
80 dome shaped for 30
82 golf ball It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A container with a tube insert for holding various articles which comprises:

a) a receptacle in which material is held and carried therein;

b) a tube insert incorporated within said receptacle, for holding one of the articles therein, said tube insert including an elongated hollow cylinder having a closed end, an opened end and a compartment for holding the one article therein;

c) means incorporated to said receptacle and in conjunction with said tube insert, for allowing removal of the one article therefrom without a person having to open said receptacle, said removal means including an aperture in said receptacle, an easy access cover connected to said receptacle at said aperture and the opened end of said elongated hollow cylinder, a spring inserted within the compartment of said elongated hollow cylinder and against the closed end thereof, and a disc member inserted within the compartment of said elongated hollow cylinder and attached to a free end of said spring, so as to help eject the one article therefrom when said easy access cover is placed in an opened position, said easy access cover including a hinge connected between one side of said easy access cover and said receptacle so that said easy access cover can be pivoted to the opened position and a closed position at the opened end of said elongated hollow cylinder and means for retaining said easy access cover when in the closed position over the opened end of said elongated hollow cylinder so as to keep the one article within the compartment in said elongated hollow cylinder;

d) an L-shaped brace member having a pair of legs with a hole through one of said legs, said brace member is mounted within said receptacle at said aperture, so that said leg with said hole is positioned over the opened end of said elongated hollow cylinder behind said easy access cover to give extra support thereto, while said L-shaped brace member also supports a corner of said receptacle as well as said elongated hollow cylinder.

2. A container with a tube insert for holding various articles as recited in claim 1, wherein said retaining means includes said receptacle having a recessed area at said aperture and at the opened end of said elongated hollow cylinder and being of the same size as said easy access cover, so that when said easy access cover is placed in the closed position said recessed area will retain said access cover snugly thereto.

3. A container with a tube insert for holding various articles as recited in claim 1, wherein said retaining means is a latch member between one side of said easy access cover and said aperture of said receptacle.

4. A container with a tube insert for holding various articles as recited in claim 6, wherein said retaining means includes a ring seal gasket mounted to a back of said easy access cover, so that when said easy access cover is placed in the closed position said ring seal gasket will fit snugly within said aperture of said elongated hollow cylinder.

5. A container with a tube insert for holding various articles as recited in claim 1, wherein said retaining means includes:

a) a female snap fastener affixed to one side of said aperture on said receptacle; and b) a male snap fastener affixed to one side of said easy access cover, which will engage with said female snap fastener, when said easy access cover is placed in the closed position.

6. A container with a tube insert for holding various articles as recited in claim 2, wherein said assisting means includes said receptacle having a finger notch formed in said recessed area, so that a person can insert a fingernail into said finger notch and pull said easy access cover into the opened position.

7. A container with a tube insert for holding various articles as recited in claim 2, wherein said assisting means includes a finger grip on said easy access cover, so that a person can engage said finger grip and pull said easy access cover into the opened position.

8. A container with a tube insert for holding various articles as recited in claim 4, wherein said assisting means includes a finger grip on said easy access cover, so that a person can engage said finger grip and pull said easy access cover into the opened position.

9. A container with a tube insert for holding various articles as recited in claim 5, wherein said assisting means includes a flap member extending from said easy access cover and having said male snap fastener attached thereto, so that a person can engage said flap member and pull said easy access cover into the opened position.

10. A container with a tube insert for holding various articles as recited in claim 1, wherein said receptacle is a hand held carrier case.

11. A container with a tube insert for holding various articles which comprises:

a) a receptacle in which material is held and carried therein;

b) a tube insert incorporated within said receptacle, for holding one of the articles therein, said tube insert including an elongated hollow cylinder having a closed end, an opened end and a compartment for holding the one article therein;

c) means incorporated to said receptacle and in conjunction with said tube insert, for allowing removal of the one article therefrom, said removal means including an aperture in said receptacle, an easy access cover connected to said receptacle at said aperture and the opened end of said elongated hollow cylinder, a spring inserted within the compartment of said elongated hollow cylinder and against the closed end thereof, and a disc member inserted within the compartment of said elongated hollow cylinder and attached to a free end of said spring, so as to help eject the one article therefrom when said easy access cover is placed in an opened position, said easy access cover including a hinge connected between one side of said easy access cover and said receptacle so that said easy access cover can be pivoted to the opened position and a closed position at the opened end of said elongated hollow cylinder and means for retaining said easy access cover when in the closed position over the opened end of said elongated hollow cylinder so as to keep the one article within the compartment in said elongated hollow cylinder;

d) an L-shaped brace member having a pair of legs with a hole through one of said legs, said brace member is mounted within said receptacle at said aperture, so that said leg with said hole is positioned over the opened end of said elongated hollow cylinder behind said easy access cover to give extra support thereto, while said L-shaped brace member also supports a corner of said receptacle as well as said elongated hollow cylinder behind said easy access cover to give extra support thereto, while said L-shaped brace member also supports a corner of said receptacle as well as said elongated hollow cylinder; and e) wherein said receptacle is a golf bag.

* * * * *